US005413088A

United States Patent [19]

Oviatt

[11] Patent Number: 5,413,088

[45] Date of Patent: May 9, 1995

[54] WOOD BURNING HEATING UNIT

[76] Inventor: William T. Oviatt, 1375 Highway 71-B North, Springdale, Ark. 72764

[21] Appl. No.: 3,727

[22] Filed: Jan. 13, 1993

[51] Int. Cl.[6] ..... F24C 1/14

[52] U.S. Cl. ..... 126/77; 126/79; 126/80; 126/289

[58] Field of Search ..... 126/77, 65, 66, 80, 126/289, 290, 285 R, 112, 76, 58, 79, 60; 110/214

[56] References Cited

U.S. PATENT DOCUMENTS

| | | | |
|---|---|---|---|
| 8,949 | 5/1852 | Kennison . | |
| 13,314 | 7/1855 | Kenney . | |
| 372,359 | 11/1887 | Chalmers | 126/79 |
| 420,503 | 2/1890 | Weston . | |
| 728,527 | 5/1903 | Waters . | |
| 924,774 | 6/1909 | Hanmer | 126/79 |
| 1,026,323 | 5/1912 | Learned . | |
| 1,939,832 | 12/1933 | Schott . | |
| 4,184,473 | 1/1980 | McIntire | 126/312 |
| 4,201,186 | 5/1980 | Paquin . | |
| 4,252,104 | 2/1981 | Morris | 126/76 |
| 4,320,738 | 3/1982 | Johnson . | |
| 4,506,653 | 3/1985 | Bigelow et al. . | |
| 4,545,360 | 10/1985 | Smith et al. . | |
| 5,014,680 | 5/1991 | Siemer | 110/214 |

FOREIGN PATENT DOCUMENTS

| | | | |
|---|---|---|---|
| 215373 | 9/1941 | Switzerland | 126/77 |
| 379937 | 9/1932 | United Kingdom | 126/76 |

*Primary Examiner*—James C. Yeung
*Attorney, Agent, or Firm*—Boyd D. Cox

[57] ABSTRACT

An improved wood burning heating unit which possesses a trapezoidal housing including a fire box portion possessing in a combustion zone a fire brick grid for supporting fuel wood. An air duct extends beneath the fire brick grid, upwardly along a back portion of the heating unit, and terminates in fluid communication with a helical heat exchanger section. The heat exchanger section surrounds a central chimney including an open upper end and an open lower end selectively closable by a damper. An outside air T connection includes a first leg connected to an outside air inlet, a second leg communicating with the chimney, above the heat exchanger section, and a third leg connected for directing combustion air to the fire box. The outside air T connection also includes a pair of air pressure actuated flapper valves for regulating combustion air flow depending upon conditions within the fire box. In operation, combustion air flows from the outside air inlet to the fire box and combustion gasses flow upwardly over a fireback, downwardly through a hollow air flow space behind the fireback, through and below the fire brick grid, upwardly through the exhaust conduit, through the helical heat exchanger, and outwardly to ambient through the central chimney. A bypass damper in the chimney allows direct exhaust of combustion gasses during start up.

22 Claims, 8 Drawing Sheets

WOOD BURNING HEATING UNIT

BACKGROUND OF THE INVENTION

The present invention relates to heating units, and more particularly pertains to wood burning heating units such as stoves and fireplaces. In conventional stoves and fireplaces, a large portion of the heat from the fire, along with many partially and completely unburned gasses are exhausted through the chimney. In addition to creating air pollution problems, the exhaust of unburned combustion gasses results in reduced heating efficiency. Accordingly, the present invention is directed to the provision of an improved wood burning heating unit possessing combustion air and exhaust gas flow paths adapted to maximize heating efficiency and minimize the exhaust of unburned gasses.

SUMMARY OF THE INVENTION

It is an object of the present invention to provide a new and improved wood burning heating unit which possesses a trapezoidal housing including a fire box portion possessing in a combustion zone a fire brick grid for supporting fuel wood. An exhaust air conduit extends beneath the fire brick grid, upwardly along a back portion of the heating unit, and terminates in fluid communication with a helical heat exchanger section. The heat exchanger section surrounds a central chimney including an open upper end and an open lower end selectively closable by a damper. An outside air T connection includes a first leg connected to an outside air inlet, a second leg communicating with the chimney, above the heat exchanger section, and a third leg connected for directing combustion air to the fire box. The outside air T connection also includes a pair of air pressure actuated flapper valves for regulating combustion air flow depending upon ambient air conditions, as well as conditions within the fire box. In operation, combustion air flows from the outside air inlet to the fire box, upwardly over a fireback, downwardly along and externally of the exhaust air conduit, through and below the fire brick grid, upwardly through the exhaust conduit, through the helical heat exchanger, and outwardly to ambient through the central chimney. A bypass damper in the chimney allows direct exhaust of combustion gasses during start up and at other selected times. A safety trip mechanism including a thermocouple and a microswitch is operative to open the damper depending upon temperature and draft conditions in the heating unit.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
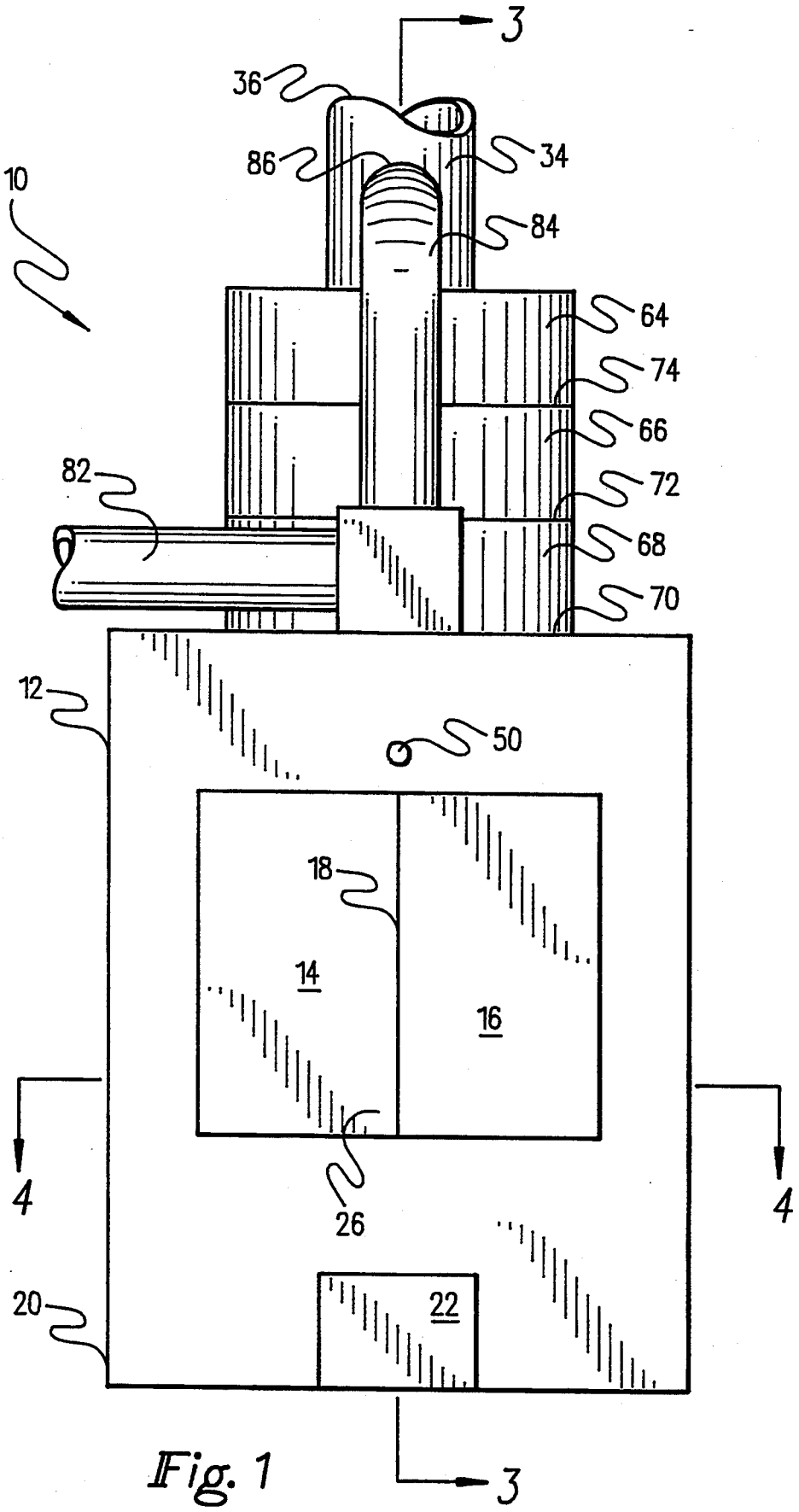
FIG. 1 is a front elevational view illustrating the improved heating unit according to the present invention.
Figure 2:
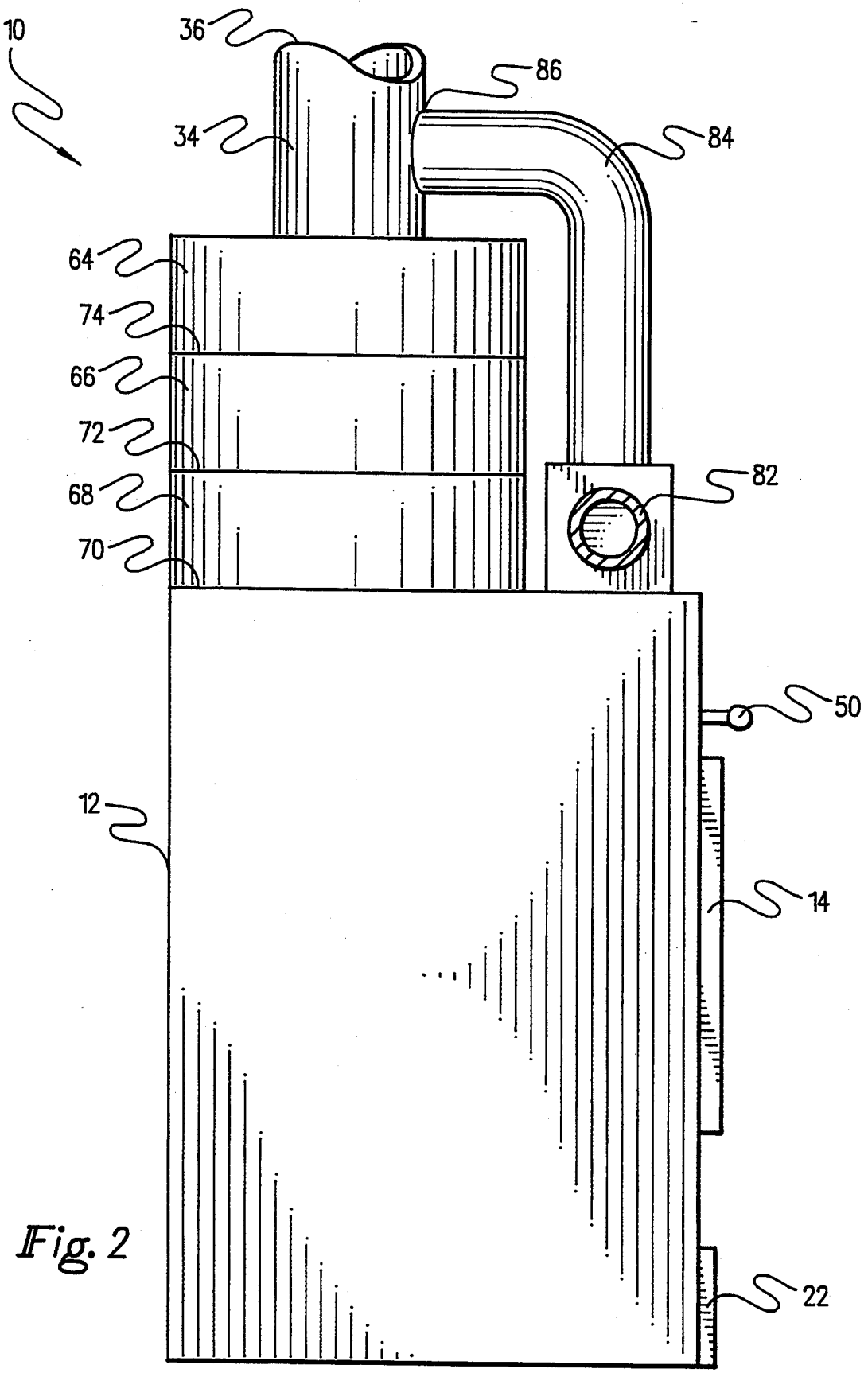
FIG. 2 is a side elevational view of the improved heating unit according to the present invention.
Figure 3:
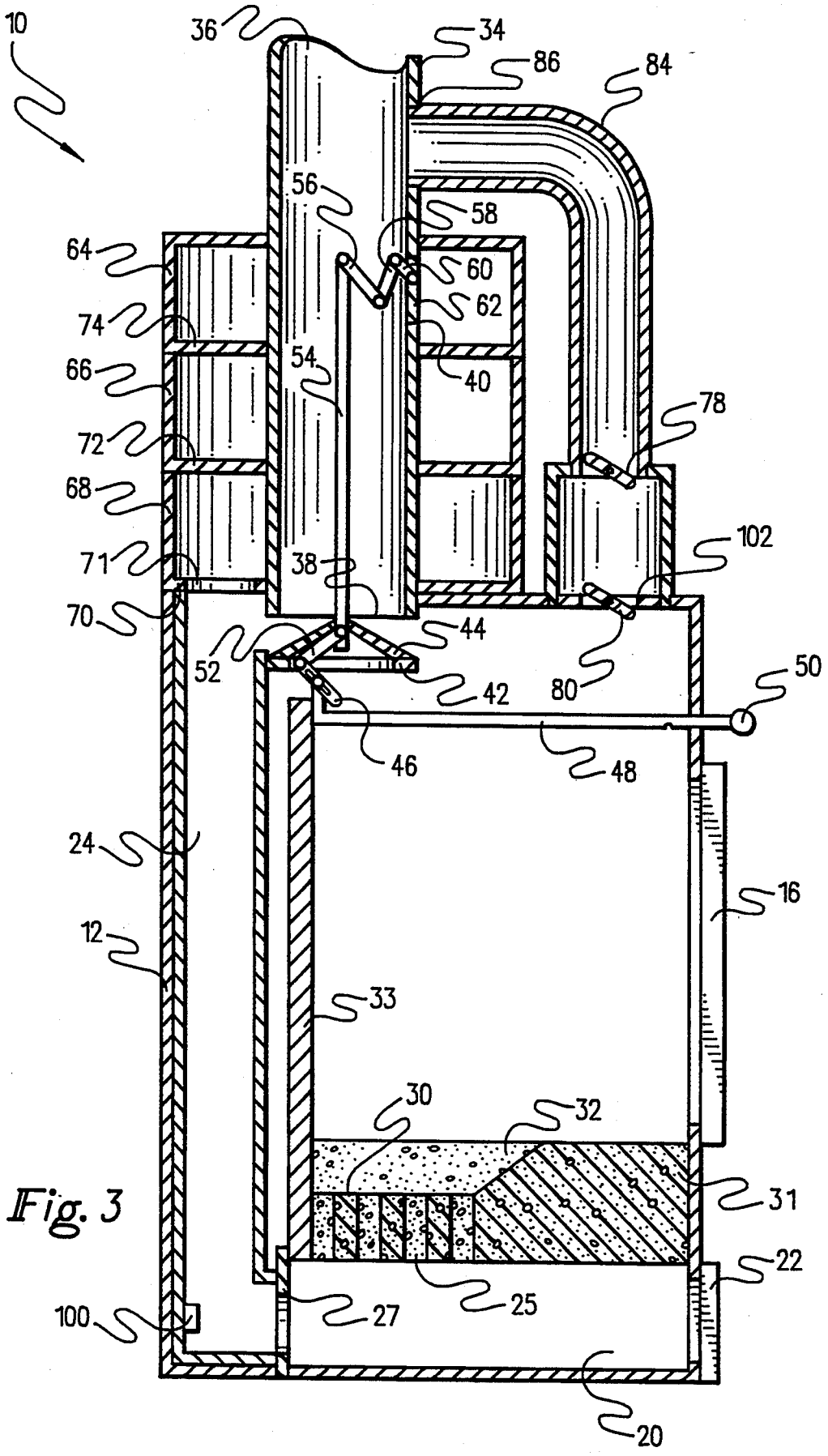
FIG. 3 is a longitudinal cross-sectional view taken along line 3—3 of FIG. 1.
Figure 4:
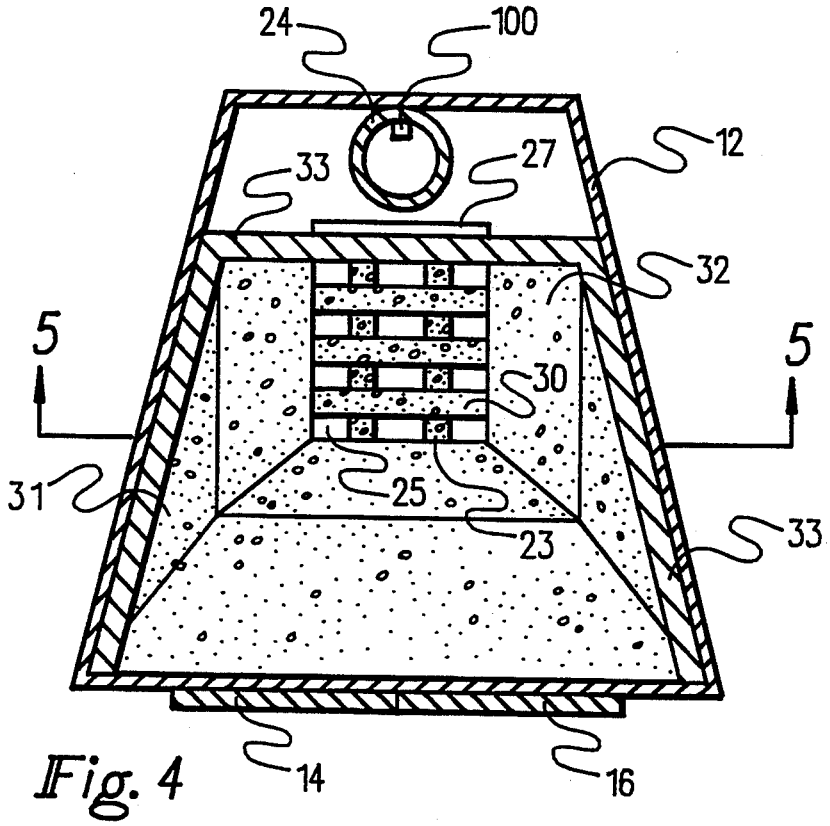
FIG. 4 is a transverse cross-sectional view taken along line 4—4 of FIG. 1.
Figure 5:
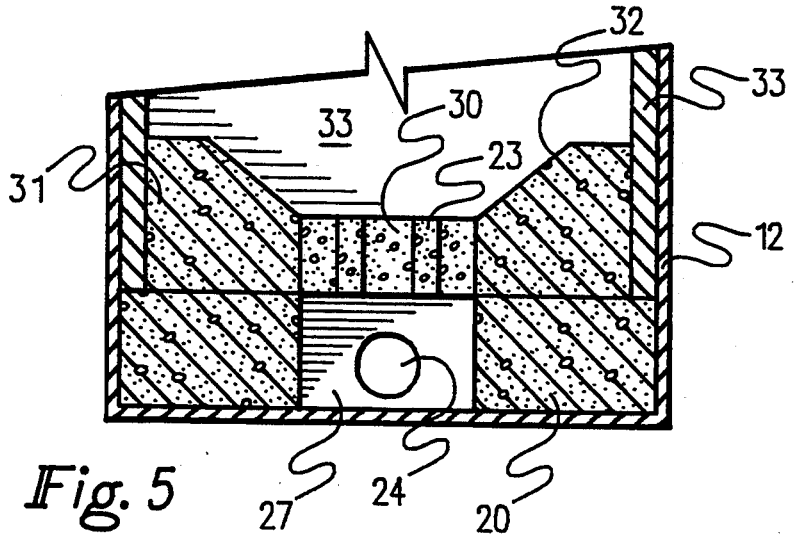
FIG. 5 is a partial longitudinal cross-sectional detail view taken along line 5—5 of FIG. 4.
Figure 6:
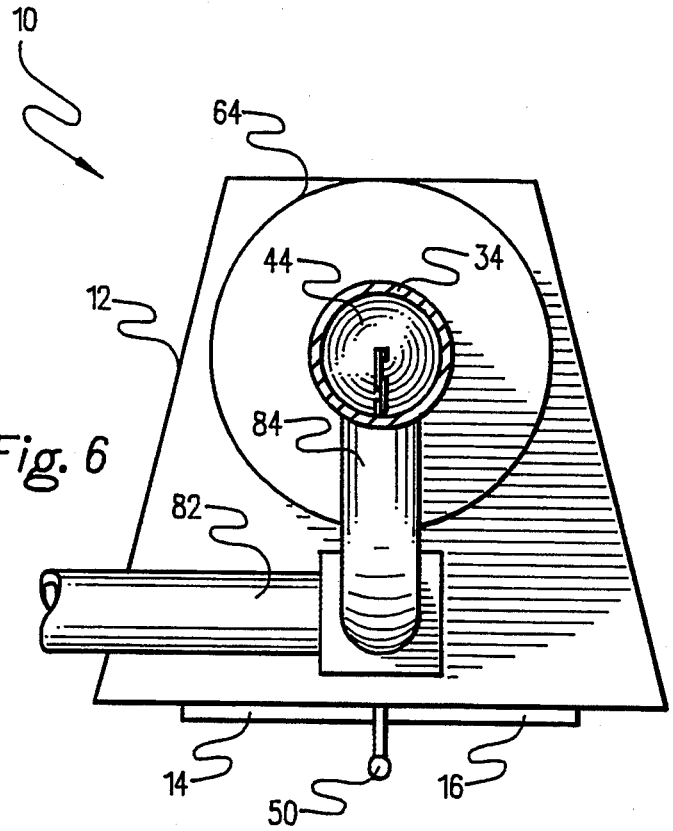
FIG. 6 is a top plan view illustrating the improved heating unit according to the present invention.

Referring now to the drawings, wherein like reference numerals designate corresponding structure throughout the views, and referring in particular to FIGS. 1 through 3, an improved wood burning heating unit 10 according to a first preferred embodiment of the invention will be described. The heating unit 10 includes a trapezoidal housing 12 having a fire box section 26 preferably including swinging glass doors 14 and 16 which meet along a longitudinal line of intersection 18. A lowermost section 20 of the heating unit 10 includes a centrally disposed door 22 which covers a rearwardly extending rectangular channel-shaped air duct 23 possessing an open top portion 25 which underlies a fire brick grid 30. The rearwardly extending duct 23 terminates at an intersection formed by a coupling flange 27 with a vertically extending exhaust conduit 24. The fire box section 26 of the heating unit 10 includes one or more blocks 31 formed from a suitable non-combustible refractory material provided with a combustion zone in the shape of a pyramidal recess 32 adapted to receive a wood fuel load supported on the fire brick grid 30. As can be appreciated from FIG. 4, the fire brick grid 30 is formed by transversely intersecting struts formed from a non-combustible material such as fire brick or the like. A fireback 33 formed from a non-combustible refractory material such as fire brick separates the fire box from the exhaust gas conduit 24 and defines a hollow air flow space between the fireback 33 and the back wall of the housing 12 which is adjacent to, but isolated from the exhaust conduit 24. The exhaust gas conduit 24 is preferably surrounded and insulated by a conventional castable thermal insulating material such as those sold under the trademarks "CASTABLE INSULATION NO. 22" and "KS-4" by A P GREEN REFRACTORIES COMPANY Of Mexico, Mo. A vertically extending cylindrical chimney 34 includes a circular open upper end 36 and a circular open lower end 38. A damper 42 includes a centering cone 44 and is adapted for axial movement into the open lower end 38 of the chimney 34 for the purpose of selectively closing the air flow path therethrough. A pivotal linkage for axially raising and lowering the damper 42 includes a first pivotal strut 46 connected to an actuating rod 48 terminating in a handle 50. A pin 37 fixed to the rod 48 extends through a slot in the first pivotal strut 46, forming a lost motion connection which converts linear reciprocal movement of rod 48 into arcuate pivotal movement of strut 46. The lower end of strut 46 is attached to bracket 47 by means of pivot connection 43. The bracket 47 is fixedly attached to the top of housing 12. A second pivotal strut 52 possesses a first end pivotally connected by pivot connection 39 to the upper end of strut 46 and a second end pivotally connected at pivot connection 55 to a vertically extending extension rod 54. Additional pivotal struts 56, 58, and 60 terminate in a connection with a flapper door 62 adapted to selectively open and close a circular exhaust portal 40 formed in the side wall of the chimney 34. The pivotal linkage connects the damper 42 and door 62 in inverse relation, such that when damper 42 is open (FIG. 8), door 62 is closed. Conversely, when damper 42 is closed (FIG. 9) door 62 is open.

Figure 10:
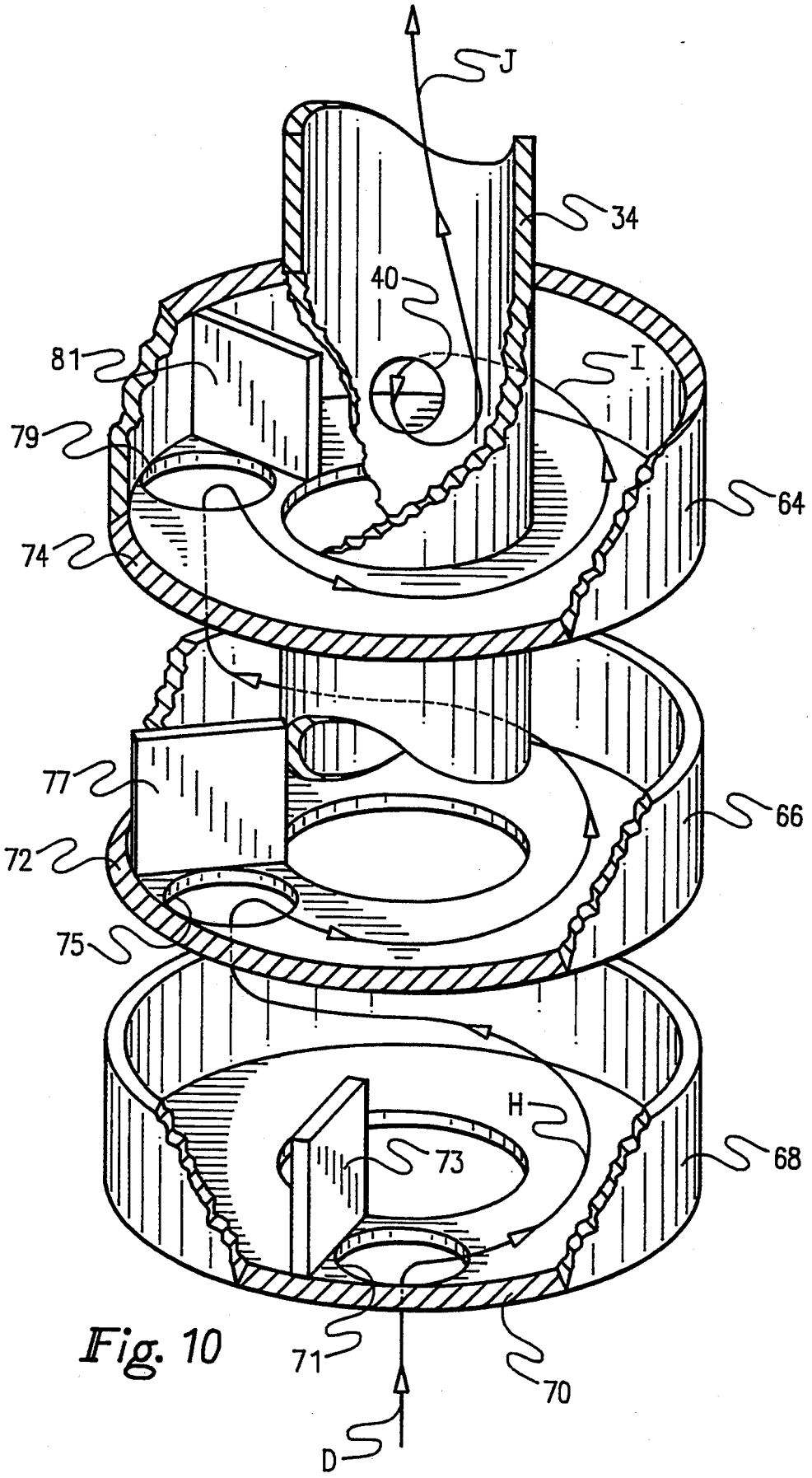
FIG. 10 is a diagrammatic perspective view illustrating the air flow through the heat exchanger section of the improved heating unit according to the present invention.

A helical heat exchanger includes three stacked cylindrical sections 64, 66, and 68 possessing respective circular dividing floors 74, 72, and 70. As can be appreciated from FIG. 10, a first exhaust aperture 71 is formed through floor 70 of heat exchanger section 68 in axial alignment with exhaust conduit 24. A vertically and radially extending baffle plate 73 is disposed between floors 70 and 72, thus forcing exhaust gas from conduit 24 to flow in a circular path within heat exchanger first stage section 68, as shown by flow path H. After completing a nearly 360 degree circular path, the exhaust gas travels through a second exhaust port 75 formed through heat exchanger floor 72. A second baffle plate 77 extending radially and vertically between floors 72 and 74 again forces the exhaust gasses to flow in a nearly 360 degree circular path within the second stage section 66 of the heat exchanger. The exhaust gas then travels through a third exhaust aperture 79 formed through the floor 74 of third stage section 64 of the heat exchanger. A third radially extending baffle plate 81 extends between floor 74 and the upper wall of heat exchanger section 64, causing the exhaust gasses to again travel in a nearly 360 degree circular path before exiting through exhaust portal 40 formed through the side wall of the chimney 34, as indicated by flow paths I and J.

Outside combustion air is supplied from an outside air conduit 82 connected to the heating unit 10 by a T-connection. The first leg of the T-connection is formed by the conduit 82 which extends to an external source of combustion air. A second leg of the T-connection communicates with the fire box 26 via an air pressure actuated flapper valve 80. A third leg 84 of the T-connection intersects the chimney 34 at union 86. A second air pressure flapper valve 78 controls air flow through conduit 84 dependent upon air pressure within chimney 34.

Figure 7:
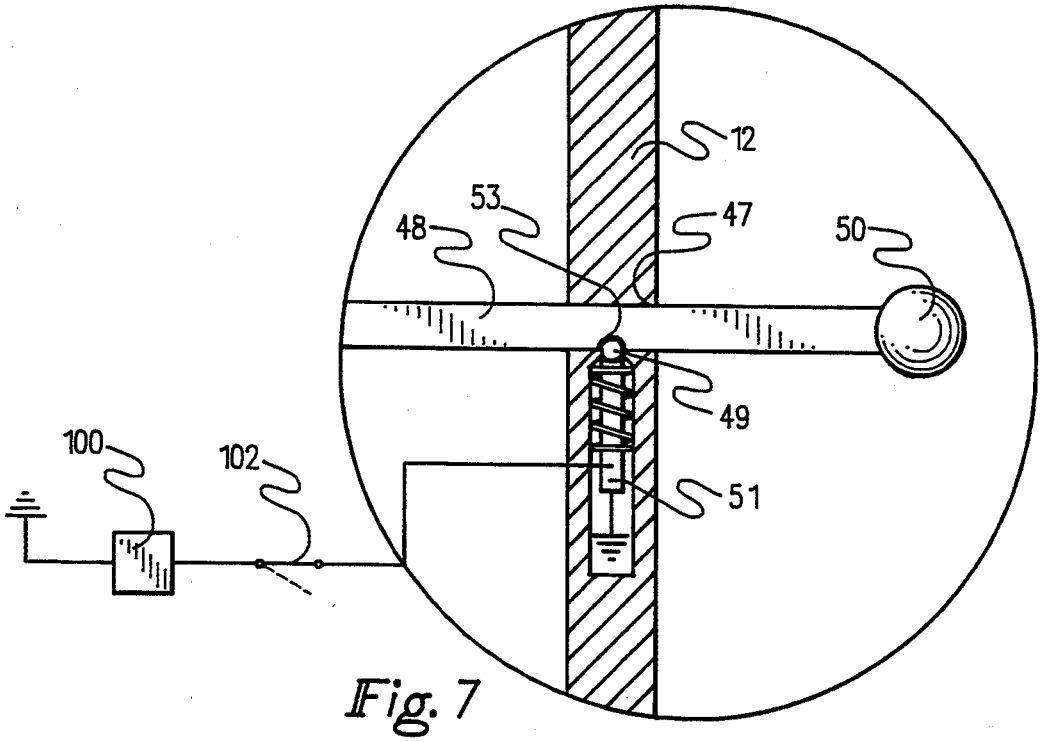
FIG. 7 is an enlarged detail view illustrating the bypass damper control handle in a closed position.
Figure 8:
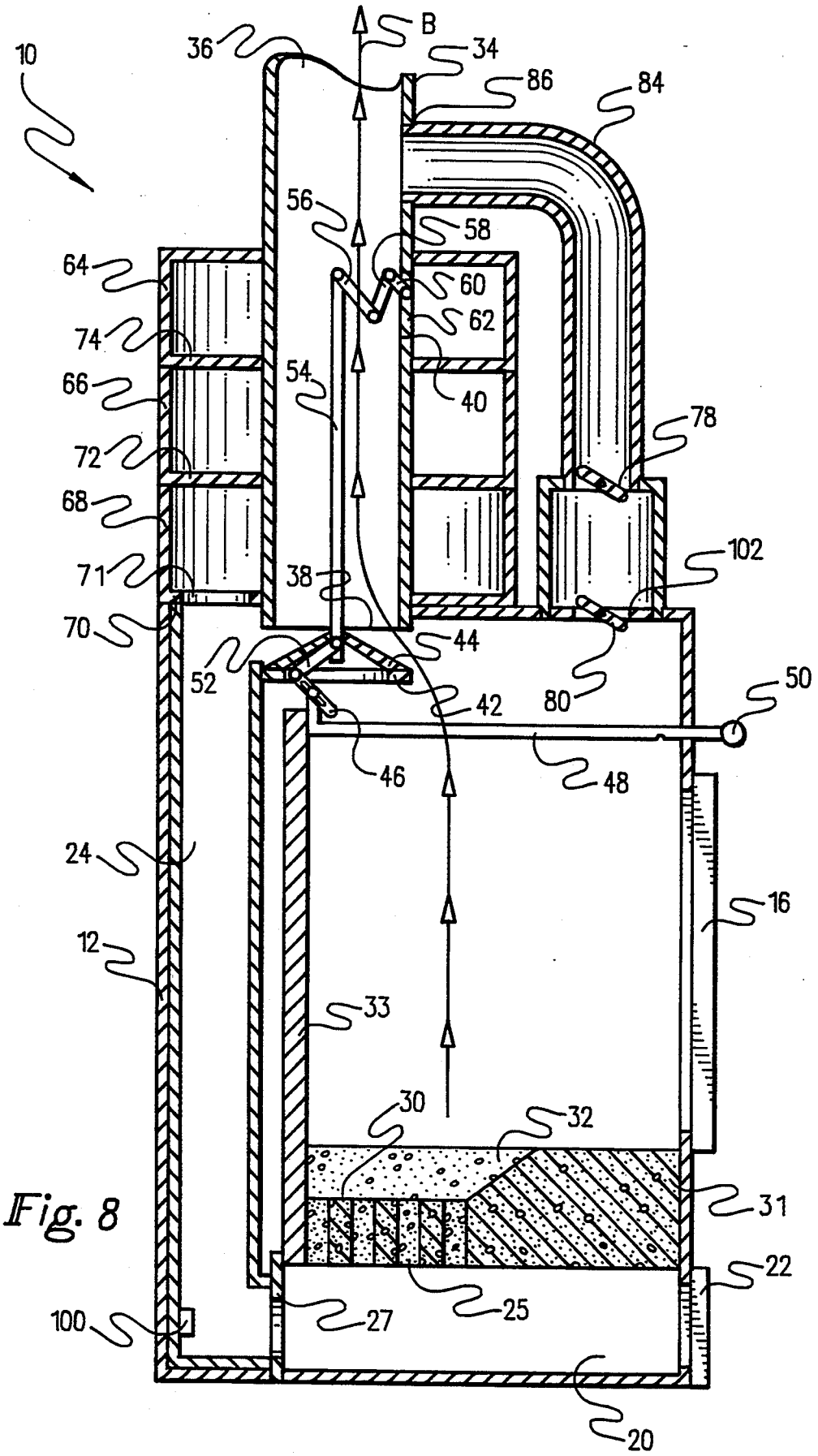
FIG. 8 is a longitudinal cross-sectional detail view taken along line 3—3 of FIG. 1, illustrating air flow through the improved heating unit according to the present invention with the bypass damper in an open position.

In operation, the damper 42 is initially oriented in the open position shown in FIG. 8 by manipulating the actuating rod 48 to the position illustrated in FIG. 8. The damper control mechanism preferably includes an aperture 47 (FIG. 7) formed through the housing 12 for mounting the actuating rod 48 for reciprocal sliding movement therethrough. As will be described in more detail subsequently, a ball detent 49 is controlled by an electromagnet 51 for engagement with a recess 53 formed in the rod 48. A plurality of recesses 53 may be disposed along the actuating rod 48 within the scope of the invention to provide a tactile feedback of a plurality of predetermined damper positions.

In the fully open position of the damper 42 illustrated in FIG. 8, the heat exchanger exhaust portal 40 in the side wall of the chimney 34 is closed by flapper door 62, due to the interconnecting pivotal linkage 54, 56, 58, and 60. Accordingly, the damper 42 and flapper door 62 are mechanically connected in inverse relationship such that when one is closed, the other is open, and vice versa. With the damper 42 open, a kindling fire is started within the combustion zone 32 by placing paper, kindling wood, or other similar starter materials on the fire brick grid 30 within the combustion zone 32. Combustion air from an outside source travels through conduit 82 and air pressure control flapper valve 80 into the fire box 26. Because heat exchanger exhaust portal 40 is closed, exhaust gasses can escape only through the open lower end 38 of the chimney 34, as indicated by flow path B.

After the fire is started within the combustion zone 32, a full fuel load, for example several logs, is added through the front doors 14 and 16. Once the doors 14 and 16 are closed, the damper 42 is moved to the fully closed position illustrated in FIGS. 7 and 9. As shown in FIG. 7, the detent ball 49 will preferably be in engagement with the recess 53 formed in the actuating rod 48, when the damper 42 is in the fully closed position. In the normal operating condition of the heat exchanger 10 illustrated in FIG. 9, combustion air initially enters the fire box 26 through conduit 82 and flapper valve 80, as shown by flow path C. A portion of the combustion air and resulting exhaust gasses initially travels through the fuel load and fire brick grid 30, and then through exhaust conduit 24, as indicated by flow path D. As the fuel load is partially consumed, a bed of red hot glowing coals collects in and partially occludes the openings formed through the fire brick grid 30. After this condition occurs, the exhaust gasses travel upwardly over a refractory fireback 33 as indicated by flow path E, and downwardly through the hollow space adjacent exhaust conduit 24 as shown by flow path F. The exhaust gasses then circulate within and around the fire brick grid 30 as shown by flow path G. During flow through and around the fire brick grid 30, the exhaust gasses come into contact with the red hot glowing coals therein. Any partially uncombusted fuel gasses are substantially completely burned. After the gasses of flow path G are substantially completely combusted, the resulting hotter exhaust gasses travel upwardly through exhaust conduit 24 as indicated at flow path D. After flowing through the preferably thermally insulated exhaust conduit 24, the exhaust gasses travel in a substantially helical flow path through heat exchanger sections 68, 66, and 64, as indicated by flow paths H and I. The now cooled exhaust gasses then enter chimney 34 through side wall exhaust portal 40 from third stage heat exchanger section 64 and are exhausted through the open upper end of chimney 36 as indicated by flow path J. The heat from the heat exchanger may be transferred to air, water, or a solid storage mass in a conventional manner for use in home air or water heating.

The air pressure controlled flapper valves 78 and 80 are barometric type dampers of the type adjustable against a closing spring. A suitable barometric damper for use as flapper valves 78 and 80 is manufactured by Field Control Division Company of Mendota, Ill., under the designation Barometric Draft Control, Type RA. The bottom flapper valve 80 is adjusted to a minimal setting such that even the smallest amount of air flow C holds the flapper valve 80 wide open, allowing a constant flow of air to the fire box 26. The top flapper valve 78 is adjusted to a predetermined, heavier setting which requires a stronger draft pull for opening the valve 78. The dual air pressure actuated flapper valves 78 and 80 allows adjustment for a constant draft to the fire box 26. If an excess draft does occur due to a very tall chimney, high winds, etc., the valve 78 opens, diverting some of the combustion air directly to the chimney 34 through combustion air diversion conduit 84, along flow path K. The resulting constant draft conditions to the fire box 26 prevents over-firing. Also, the bottom flapper valve 80 is equipped with a safety trip mechanism such that if for any reason draft through the fire box 26 is impeded, allowing the flapper valve 80 to close, then the bypass damper 42 is released and falls to an open position to allow direct access from the fire box 26 to the chimney 34. If the glass doors 14 and 16 are open before the bypass damper 42 is opened, the incoming air through the open glass doors supplies air from the room to the fire box 26, interrupting draft through the flapper valve 80, and causing the trip mechanism to release the bypass damper 42 to the open position. This dual barometric control system enables the heating unit 10 to be self-regulating for convenient and efficient operation.

Figure 9:
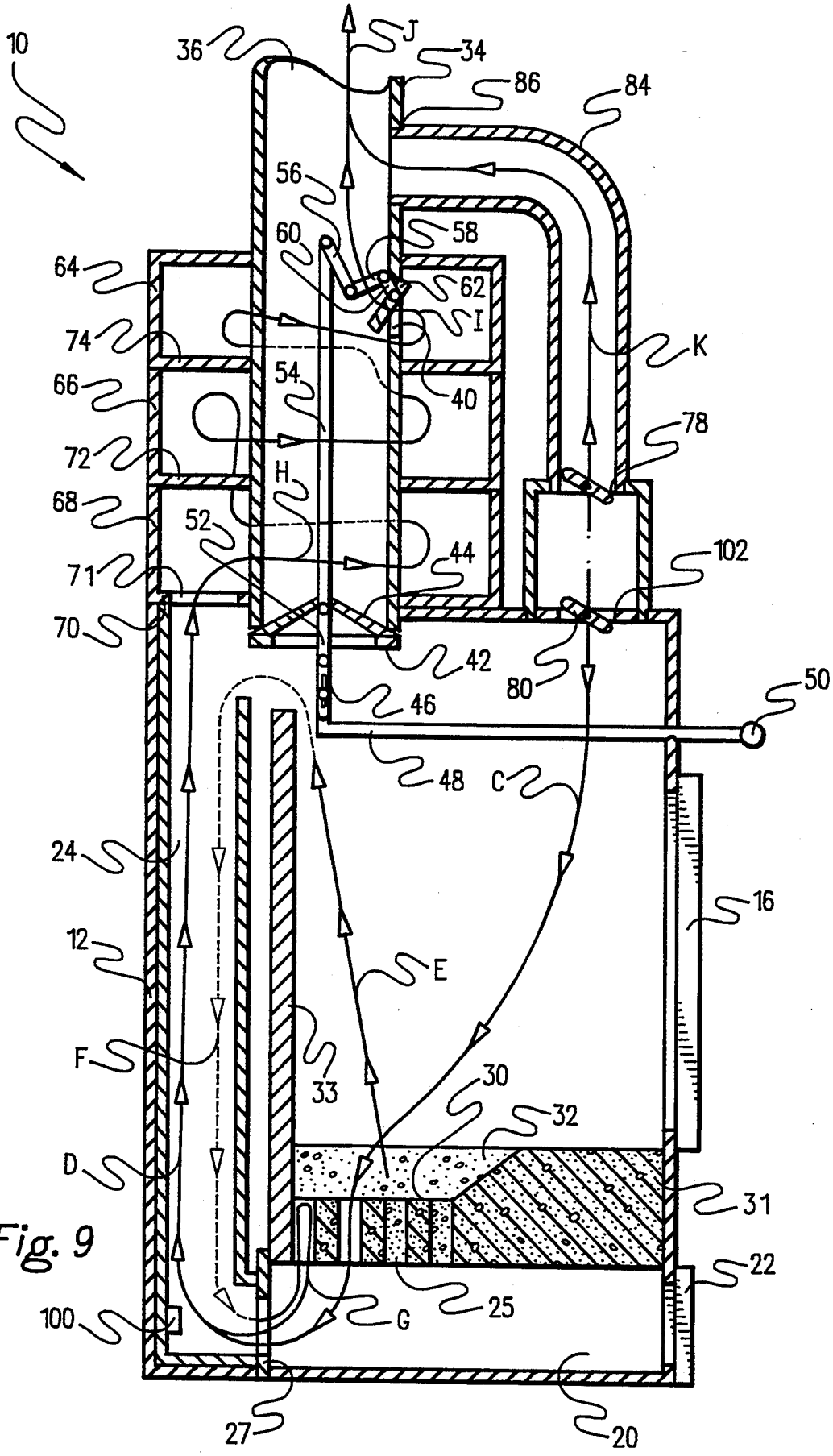
FIG. 9 is a longitudinal cross-sectional detail view taken along line 3—3 of FIG. 1, illustrating air flow through the improved heating unit according to the present invention with the bypass damper in a closed position.

With reference to FIGS. 7 through 9, the trip mechanism comprises a millivolt generating thermocouple 100 connected to an electromagnet 51 which controls the detent 49 for selective extension and retraction into and out of engagement with the recess 53 in the control rod 48, somewhat in the manner of a solenoid. A suitable thermocouple for use in the trip mechanism is manufactured by Honeywell, Inc., Minneapolis, Minn. under the designation Universal Thermocouple, model no. Q340A1090. A suitable electromagnet for use in the trip mechanism can be removed from a Thermocouple Pilot Switch, model no. 2E231, manufactured by Dayton Electric Mfg. Co., Chicago, Ill. A commonly available microswitch 102 is installed between the thermocouple 100 and electromagnet 51 and connected to the flapper valve 80 such that if flapper valve 80 is closed, the microswitch 102 is open, disallowing current to flow from the thermocouple 100 to the electromagnet 51. If flapper valve 80 is open, the microswitch 102 is closed, allowing current to flow from the thermocouple 100 to the electromagnet 51. The sensing element of the thermocouple 100 is preferably situated in the lower portion of exhaust conduit 24 where the exhaust gasses are near their highest temperatures. When the thermocouple sensing element attains a preselected temperature (and when conditions are such that flapper valve 80 is open), the power generated by the thermocouple 100 actuates the electromagnet 51, which forces the detent 49 into an extended position as shown in FIG. 7. The force exerted by the detent 49 in this extended position, is sufficient, when the detent 49 is engaged in recess 53, to hold the damper 42 in a closed position against the force of gravity acting on damper 42 and the attached pivotal linkage. A spring 59 is biased to retract the detent 49 when the electromagnet 51 is deactivated. Hence, when either the temperature in the heating unit 10 is not sufficient to maintain the power required to activate the electromagnet 51, or the flapper valve 80 is closed and the microswitch 102 is open, the spring 59 will retract the detent 49 and the damper 42 will fall to its open position due to gravitational forces.

It should be noted that preferably when the damper 42 is in its fully closed position, the pivotal struts 46 and 52 will not be in exact vertical alignment. Instead an angular relationship will exist between struts 46 and 52 when the detent 49 is seated in recess 53 of rod 48. This arrangement facilitates the opening of the damper 42 by gravitational forces when the detent 49 is retracted.

In addition to the advantages discussed above, the described trip mechanism functions as an energy saving device in that when the fuel in the heating unit 10 extinguishes and the temperature therein decreases, the damper 42 opens due to deactivation of the electromagnet 51 and unused combustion air drafts up the chimney 34, rather than through the heat exchanger. Consequently, the outside cool combustion air does not cool off elements of the heat exchanger.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An improved heating unit, comprising:

a housing;

a firebox portion in said housing;

an exhaust conduit for directing exhaust gasses from said firebox;

a chimney operably connected with said exhaust conduit for directing exhaust gasses to ambient;

an air inlet for communicating combustion air to said firebox, said air inlet including a first conduit connected to an external air supply, a second conduit connected to said firebox, and a third conduit connected to said chimney;

a first air pressure regulated valve disposed for opening and closing said second conduit dependent upon air pressure conditions in said firebox; and a second air pressure regulated valve disposed for opening and closing said third conduit dependent upon air pressure conditions in said chimney;

a damper in said chimney; and a trip mechanism connected to said first air pressure regulated valve and said damper for opening said damper in the substantial absence of air flow through said second conduit.

2. The heating unit of claim 1, wherein said trip mechanism includes a thermocouple operative to produce electrical current when a predetermined temperature condition exists in said exhaust conduit;

a switch operative to detect open and closed positions of said first air pressure regulated valve;

an operating linkage connected to said damper; and an electromagnetically actuated detent operative to selectively control said operating linkage dependent upon conditions detected by said thermocouple and said switch.

3. The heating unit of claim 1, further comprising:

a heat exchanger operably connected to said exhaust conduit for substantially preventing exhaust gas flow through said chimney in a closed position of said damper and for directing exhaust gas flow through said chimney in an open position of said damper.

4. The heating unit of claim 3, further comprising an exhaust portal in a sidewall of said chimney in fluid communication with said heat exchanger.

5. The heating unit of claim 4, further comprising means for selectively opening and closing said exhaust portal.

6. The heating unit of claim 4, further comprising means for opening said exhaust portal when said damper is closed and for closing said exhaust portal when said damper is opened.

7. The heating unit of claim 3, wherein said heat exchanger directs exhaust gasses in a path at least partially contacting an external surface of said chimney.

8. The heating unit of claim 1, further comprising:
a fuel load supporting grid in said firebox; and
means operably associated with said grid for directing unburned and partially burned fuel gasses at least partially upwardly through said grid.

9. The heating unit of claim 1, further comprising:
a fuel load supporting grid in said firebox; and
means operably associated with said grid for directing unburned and partially burned fuel gasses at least partially upwardly through and around said grid.

10. The heating unit of claim 1, further comprising:
a fuel load supporting grid in said firebox; and
means operably associated with said grid for directing unburned and partially burned fuel gasses at least partially upwardly through and then downwardly under said grid.

11. The heating unit of claim 1, further comprising:
a fuel load supporting grid in said firebox; and
means operably associated with said grid for directing unburned and partially burned fuel gasses at least partially in an upwardly direction then in a downwardly direction through said grid.

12. The heating unit of claim 11, further comprising an exhaust gas conduit including a portion extending beneath said fuel load supporting grid and in fluid communication therewith.

13. The heating unit of claim 12, further comprising a fireback defining a hollow air flow space between said fire box and a back wall of said housing.

14. The heating unit of claim 13, wherein said hollow air flow space communicates with said fuel load supporting grid.

15. An improved wood burning heating unit, comprising:
a housing;
a firebox portion in said housing;
an air inlet operably connected for communicating combustion air to said firebox;
an exhaust conduit for directing exhaust gasses from said firebox;
a chimney operably connected with said exhaust conduit for directing exhaust gasses to ambient;
said air inlet including a first conduit connected to an external air supply, a second conduit connected to said firebox, and a third conduit connected to said chimney;
a first air pressure regulated valve disposed for opening and closing said second conduit dependent upon air pressure conditions in said firebox;
a second air pressure regulated valve disposed for opening and closing said third conduit dependent upon air pressure conditions in said chimney;
a damper in said chimney;
a trip mechanism operatively connected with said first air pressure regulated valve and said damper for opening said damper in the substantial absence of air flow through said second conduit;
a heat exchanger operably connected to said exhaust conduit for directing exhaust gas flow through said heat exchanger in a closed position of said damper and for directing exhaust gas flow through said chimney in an open position of said damper;
an exhaust portal in a sidewall of said chimney in fluid communication with said heat exchanger;
a door for selectively opening and closing said exhaust portal; and
means for opening said exhaust portal door when said damper is closed and for closing said exhaust portal door when said damper is opened.

16. An improved heating unit, comprising:
a housing;
a firebox portion in said housing;
an air inlet operably connected to said firebox for communicating combustion air to said firebox;
an exhaust conduit operably connected to said firebox for directing exhaust gasses from said firebox;
a chimney operably connected with said exhaust conduit for directing exhaust gasses to ambient;
a fuel load supporting grid disposed in said firebox; and
means operably associated with said grid for requiring unburned and partially burned fuel gasses to pass at least partially upwardly through and around said grid prior to permitting passage of said gasses to said exhaust conduit.

17. An improved heating unit, comprising:
a housing;
a firebox portion in said housing;
an air inlet operably connected to said firebox for communicating combustion air to said firebox;
an exhaust conduit operably connected to said firebox for directing exhaust gasses from said firebox;
a chimney operably connected with said exhaust conduit for directing exhaust gasses to ambient;
a fuel load supporting grid disposed in said firebox; and
means operably associated with said grid for requiring unburned and partially burned fuel gasses to pass at least partially upwardly through and then downwardly under said grid prior to permitting passage of said gasses to said exhaust conduit.

18. An improved heating unit, comprising:
a housing;
a firebox portion in said housing;
an air inlet operably connected to said firebox for communicating combustion air to said firebox;
an exhaust conduit operably connected to said firebox for directing exhaust gasses from said firebox;
a chimney operably connected with said exhaust conduit for directing exhaust gasses to ambient;
a fuel load supporting grid disposed in said firebox; and
means operably associated with said grid for requiring unburned and partially burned fuel gasses to pass at least partially in an upwardly direction then in a downwardly direction through said grid prior to permitting passage of said gasses to said exhaust conduit.

19. An improved heating unit, comprising:
a housing;

a firebox portion in said housing;

an air inlet operably connected to said firebox for communicating combustion air to said firebox;

an exhaust conduit operably connected to said firebox for directing exhaust gasses from said firebox;

a chimney operably connected with said exhaust conduit for directing exhaust gasses to ambient;

a fuel load supporting grid disposed in said firebox; and means operably associated with said grid for requiring unburned and partially burned fuel gasses to pass at least partially upwardly through said grid prior to permitting passage of said gasses to said exhaust conduit.

20. The heating unit of claim 19, further comprising an exhaust gas conduit including a portion extending beneath said fuel load supporting grid and in fluid communication therewith.

21. The heating unit of claim 20, further comprising a fireback defining a hollow air flow space between said fire box and a back wall of said housing.

22. The heating unit of claim 21, wherein said hollow air flow space communicates with said fuel load supporting grid.

* * * * *